US005507680A

United States Patent [19]

Watkins

[11] Patent Number: 5,507,680

[45] Date of Patent: Apr. 16, 1996

[54] CONFETTI

[76] Inventor: James O. Watkins, 14920 Mt. Nebo Rd., Poolesville, Md. 20837

[21] Appl. No.: 297,612

[22] Filed: Aug. 29, 1994

Related U.S. Application Data

[63] Continuation-in-part of Ser. No. 51,355, Apr. 23, 1993, Pat. No. 5,352,148, and a continuation-in-part of Ser. No. 80,534, Jun. 24, 1993, Pat. No. 5,403,225.

[51] Int. Cl.[6] ..... A63H 37/00

[52] U.S. Cl. ..... 446/475; 446/491

[58] Field of Search ..... 446/34, 475, 491; 40/216; 273/293

[56] References Cited

U.S. PATENT DOCUMENTS

| | | | |
|---|---|---|---|
| 1,034,402 | 7/1912 | Hardy . | |
| 1,122,421 | 12/1914 | Redington | 446/475 |
| 1,153,207 | 9/1915 | Eisenberg | 446/475 |
| 1,491,809 | 4/1924 | Macchia | 446/475 |
| 1,663,679 | 3/1928 | Carpenter | 446/475 |
| 5,338,242 | 8/1994 | Cheng | 446/475 |
| 5,352,148 | 10/1994 | Watkins | 446/475 |

FOREIGN PATENT DOCUMENTS

| | | | |
|---|---|---|---|
| 112599 | 8/1900 | Germany | 446/475 |
| 458472 | 4/1928 | Germany | 446/475 |
| 10850 | 4/1903 | United Kingdom | 446/475 |
| 341784 | 1/1931 | United Kingdom | 446/475 |
| 2275202 | 8/1994 | United Kingdom | 446/475 |

OTHER PUBLICATIONS

Johnson Smith Co., "Things you never knew existed," catalog received Dec. 31, 1992.

*Primary Examiner*—Robert A. Hafer
*Assistant Examiner*—Jeffrey D. Carlson
*Attorney, Agent, or Firm*—Bartlett & Sherer

[57] ABSTRACT

Amusement confetti is disclosed in which the individual pieces of confetti are of different aerodynamic shapes such that, when they fall through the air, some of the pieces of confetti flutter with their longitudinal axes extending substantially horizontally, while other pieces of confetti fall with their longitudinal axes extending substantially vertically, and pieces of another aerodynamic shape dart sideways as they fall downwardly.

4 Claims, 3 Drawing Sheets

CONFETTI

This Application is a Continuation-In-Part of application Ser. No. 08/051,355 filed on 23 Apr. 1993 entitled "CONFETTI ", now U.S. Pat. No. 5,352,148 and Ser. No. 08/080, 534 filed 24 Jun. 1993 entitled "CONFETTI DEVICE" now U.S. Pat. No. 5,403,225.

BACKGROUND OF THE INVENTION

This invention relates to an amusement device, and more particularly to improved forms of confetti which enable the production of visual effects not previously obtainable with conventional confetti.

Standard or conventional confetti comprises a plurality of small, loose or bulk pieces of paper which are round or square and which have diameters or lengths usually less than one-half inch. When such confetti is thrown into the air, the pieces rise into the air as a cloud or stream, and then fall rapidly to the ground, sometimes with an irregular tumbling motion, but in generally straight, vertical paths from the highest point in the air reached by each piece. Such action is acceptable at weddings or parties where the object is to shower persons with the confetti. However, such action is not very dramatic or spectacular when the object is to create a visual display such as at an indoor fireworks show. First, there is no "burst" of color like real fireworks since the loose confetti must be thrown, or ejected from a toy cannon, such that there is a cloud or stream of confetti pieces rising into the air, as opposed to, a sudden burst of pieces from a single location in the air. Second, the individual pieces of conventional confetti fall to the ground in almost straight vertical lines, and they fall relatively rapidly, sometimes with an irregular tumbling motion, but with little or no floating action or "hang" time in the air. In addition, because loose confetti has no effective mass, it cannot be projected very high into the air.

SUMMARY OF THE INVENTION

The present invention provides novel shapes of confetti such that, in one shape, the individual pieces float and "flutter" horizontally as they fall toward the ground, and in another shape, the individual pieces twirl vertically like corkscrews as they flutter downwardly. In addition, the present invention provides for a large number of such individual pieces of confetti, such as several hundred or more than a thousand, to be releasably bound together as a bundle so that the bundle may be thrown or ejected high into the air, and such that the bundle will suddenly burst into hundreds of individual pieces of confetti; each piece twirling or floating and fluttering relatively slowly to the ground, whereby an extremely dramatic and spectacular visual display may be achieved.

DETAILED DESCRIPTION

Referring to FIGS. 1–4, the individual pieces 10, 12, 14 and 16 of the confetti of the present invention are cut from sheets of colored paper, plastic film such as Mylar or PVC metalized film, or other lightweight material; fireproof and biodegradable tissue paper being preferred for reasons of safety, ease of clean-up and biodegradability. White and colored tissue paper is commercially available in thicknesses measured as eight-pound test to twenty-pound test. It has been determined that nine to twelve-pound test tissue paper, and most preferably ten-pound tissue paper, provides the most optimum combination of weight-to-stiffness such that the individual pieces of confetti remain essentially flat as they flutter horizontally, dart sideways, or twirl vertically as they slowly fall to the ground as will be more fully described hereinafter.

As further shown in FIGS. 1–4, the individual pieces 10, 12, 14 and 16 of confetti comprise various shapes of four-sided polygons, hereinafter referred to generically as elongated tetragons. Each of the elongated tetragonal shapes of pieces 10, 12, 14 and 16 has a length L, which may be in the order or one to three inches, and a width W which is substantially smaller than length L, such as in the order of one-half inch to one inch. It has been found that the L/W ratio is important in order for each of pieces 10, 12 and 14 to float downward slowly, and with a maximum fluttering motion. In general, it has been found that the length-to-width ratio L/W should be between about 2.0 to 6, and preferably between 2.0 to 4, for maximum floating and fluttering action, and for maximum hang time in the air.

Figure 1:
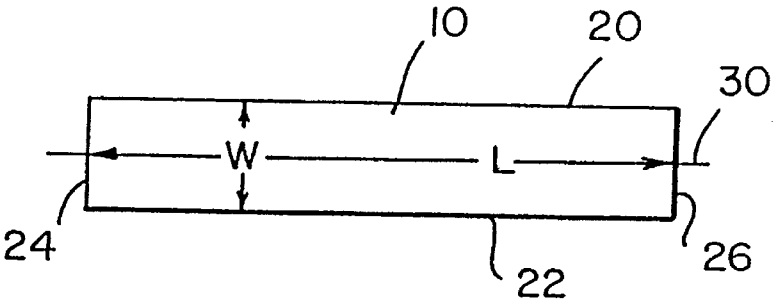
FIGS. 1–5 illustrate five different aerodynamic shapes of confetti of the present invention, each of such shapes being a form of elongated tetragon.
Figure 2:
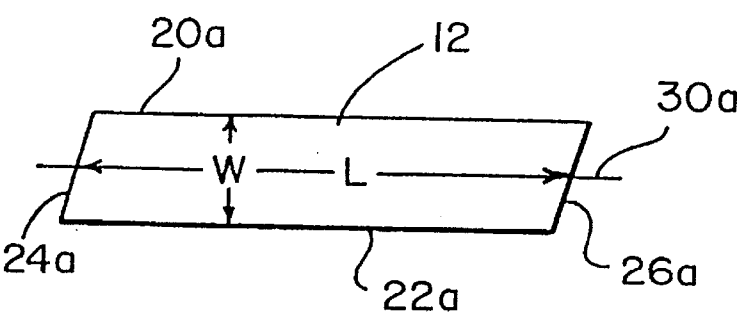
Figure 3:
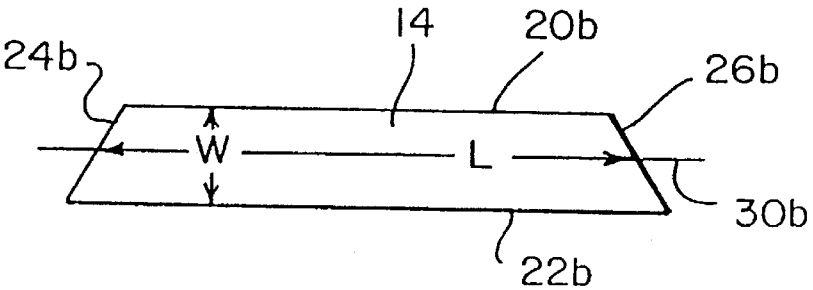
Figure 4:
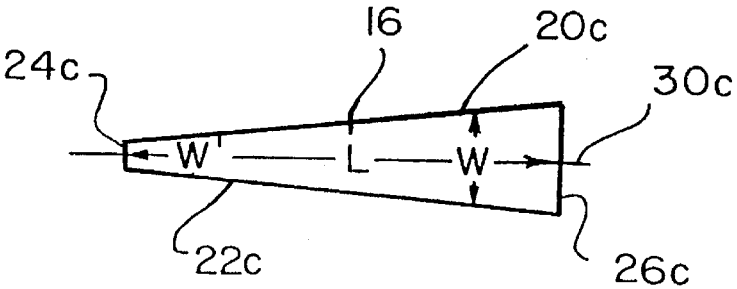

FIGS. 1–4 illustrate four preferred shapes of elongated tetragons which have been found to perform very well in terms of slowly floating downwardly with a maximum fluttering action. FIG. 1 illustrates a right-angled rectangle having elongated side edges 20, 22, and end edges 24, 26 and a longitudinal centerline 30. Similarly, as shown in FIGS. 2–4, pieces 12, 14 and 16 have elongated side edges 20*a, b, c* and 22*a, b, c*, end edges 24*a, b, d*, and 26*a, b, c*, and longitudinal centerlines 30*a, b, c*.

The elongated tetragonal shape of confetti piece 12 in FIG. 2 differs from the elongated rectangle of piece 10 in that end edges 24*a*, 26*a* are cut parallel to each other and at angles with respect to side edges 20*a*, 22*a* so as to form a parallelogram, while end edges 24*b*, 26*b* of piece 14 in FIG. 3 are cut on non-parallel lines so to form a trapezoid. Piece 16 in FIG. 4 is also an elongated tetragonal shape, however, it will be noted that side edges 20*a*, 22*c*, are cut along non-parallel lines so that width W' of end edge 24*c* is smaller than width W of opposite end edge 26*c*. Preferably, end edge 26*c* should be in the order of one-half to one inch, and end edge 24*c* should be in the order of 1/32 to 1/4 of an inch. This shape, which may also be referred to as a truncated triangle, produces a sideways darting movement as it flutters downwardly as will be more fully explained hereinafter. However, it will be understood that each of the specific shapes of elongated tetragons illustrated in FIGS. 1–4 produces a slow floating descent with unique aerodynamic motions as will be further described in detail.

Figure 6:
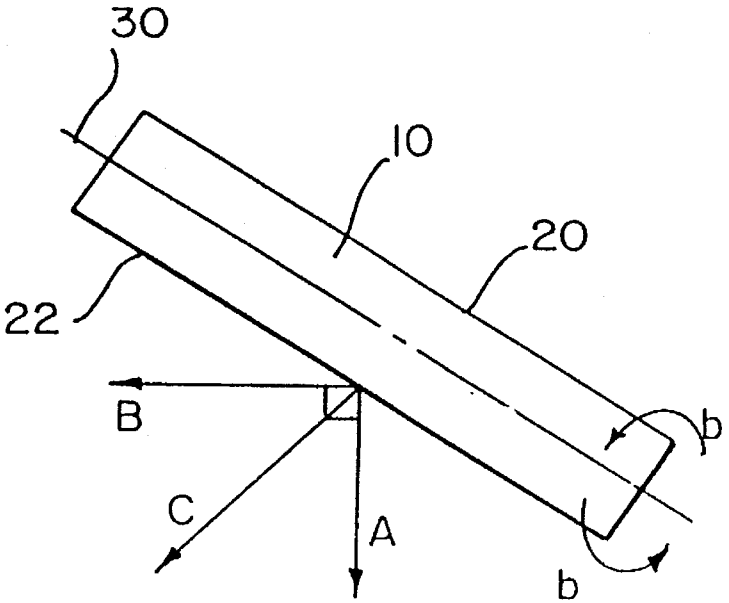

Reference is now made to FIG. 6 which is a perspective view of piece 10 of confetti as it slowly descends downwardly in the direction of arrow A to the ground. When piece 10, or pieces 12, 14 or 16, are first freed in the air, the elongated tetragonal piece quickly assumes a horizontal position with the centerline 30 and side edges 20, 22 extending substantially horizontally. That is, the piece does not drop with an end edge 24 or 26 leading in the downward direction of fall. Similarly, it does not fall with either of side edges 20, 22 leading downwardly in the direction of fall. Rather, the piece of confetti 10, 12, 14 or 16 first assumes a horizontal position, with centerline 30 and sides 20, 22 extending substantially horizontally, and then, almost immediately, begins to rotate rapidly about its centerline as indicated by rotational arrows b—b while it continues to fall slowly with axis 30 remaining in a substantially horizontal position.

The detailed aerodynamic reasons for these particular motions are not fully understood, and the theory forms no part of the present invention. However, it is believed that these motions may result from the initial lift forces of the air being substantially equal on all portions of the face surfaces of the pieces, such that it initially assumes a horizontally extending position, and that thereafter slightly unbalanced forces, such as from slightly irregular edges or non-uniformity of the paper, cause the piece to rotate about its longitudinal axis. In any event, and regardless of the aerodynamic theory, it has been discovered that pieces of confetti having the elongated tetragonal shape as described with reference to FIGS. 1–4 float to the ground relatively slowly with a long hang time in the air, and the rapid rotation of the pieces about their longitudinal centerlines appears to the eye of the observer as a rapid fluttering motion. This fluttering motion is very distinctive, and creates a unique visual impact, particularly when several hundred or more than a thousand such pieces are fluttering downwardly simultaneously. Because of this unique fluttering action, the confetti of the present invention is sometimes referred to herein by the trademark FLUTTER FETTI confetti.

The falling motion of pieces 12 and 14 is essentially the same as that just described with respect to piece 10, and the general patterns of fall of pieces 10, 12 and 14 usually include a component of horizontal motion as indicated by arrow B in FIG. 6. That is, as the pieces 10, 12 and 14 float generally downward toward the floor, as represented by vertical arrow A, they also move with a forward or horizontal, component of motion as represented by horizontal arrow B in which rotating side edges 20, 22 lead in the horizontal component of motion. Thus, the combined trajectory of fall becomes an angled descent of both forward and downward motion as represented by inclined arrow C. This forward or horizontal component of movement substantially increases the fall distance and adds substantial hang time to the fall of each piece in addition to the rotating fluttering motion which increases the floating action and decreases the rate of descent.

Figure 7:
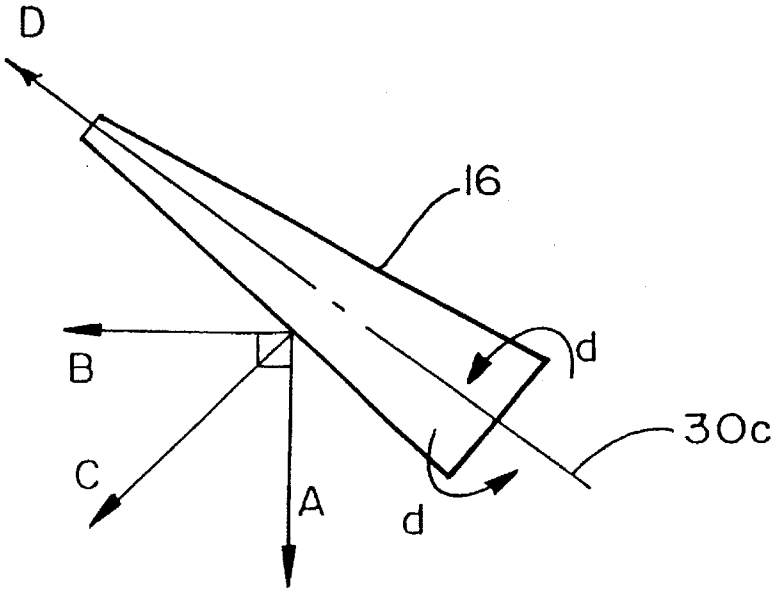
FIGS. 6–8 are perspective views of the FIG. 1, FIG. 4 and FIG. 5 shapes of the confetti of the present invention illustrating the different falling motions of the individual confetti pieces of different aerodynamic shapes.

The falling motion of pieces 16, previously described with reference to FIG. 4, includes the same fluttering, or rotational movement about centerline 30*c*, and the same forward and downward motion as just described with reference to FIG. 6. However, in addition, the unequal end edges 24*c* and 26*c* cause piece 16 to move abruptly, or dart, sideways in the direction of arrow D as illustrated in FIG. 7. That is, elongated tetragonal pieces 16 of the truncated triangle shape of FIGS. 4 and 7 execute a second horizontal movement in which smaller edge 24*c* leads the piece in a dramatic, sideways-darting movement represented by arrow D. Such sideways-darting movement may occur throughout the fall of FLUTTER FETTI piece 16, or the darting motion may stop and then begin again as the piece falls and flutters to the ground.

Figure 5:
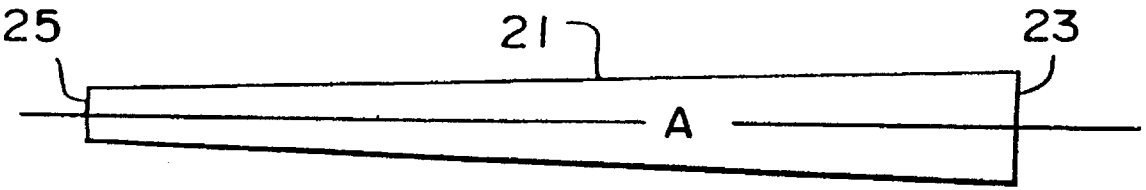

Referring to FIG. 5, a piece of elongated tetragonal confetti 21 is illustrated which has an entirely different falling motion than that described with respect to the pieces of confetti illustrated in FIGS. 1–4. FLUTTER FETTI piece 21 is in the form of a longer, truncated triangle having a length in the order of 3–6 inches and a L/W ratio in the order of 3 to 12; the L/W ratio being determined with respect to the wider end 23. For example, the width of end 25 may be in the order of 1/32 to 1/4 of an inch while end 23 may be in the order of 1/2 to 1 inch. This forms a relatively longer and proportionately narrower truncated triangle than that described with reference to FIG. 4.

Figure 8:
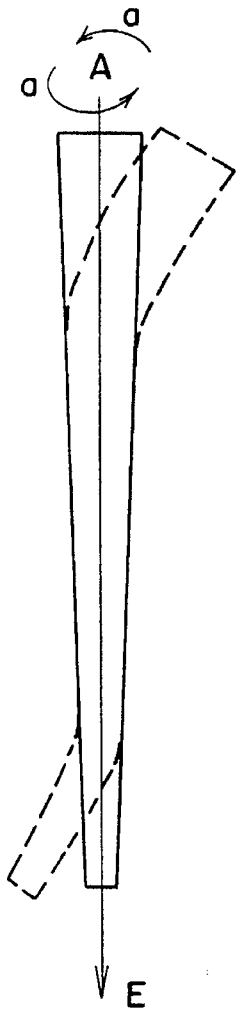

While pieces 10, 12, 14 and 16 fall with their longitudinal axes substantially horizontal, as described above with respect to FIGS. 6 and 7, it has been unexpectedly discovered that pieces of confetti of the longer truncated triangular shape described with reference to FIG. 5 fall in a vertical orientation with small end 25 leading in the direction of fall. This unique motion is illustrated in FIG. 8 wherein a piece of confetti 21 is shown as falling vertically in the direction of arrow E while the piece rotates or twirls about vertical axis A. In addition to rotating about vertical axis A, ends 23 and 25 flutter laterally; ie, horizontally, relative to the mid-portion such that the combined motion looks to the eye of the observer as a twirling corkscrew fluttering downwardly. In addition to this vertical corkscrew motion, confetti pieces in the shape described with respect to FIG. 5 fall faster than those described with respect to FIGS. 1–4. Thus, when both types of elongated tetragonal shapes are released in the air together, such as when shot into the air from a compressed air cannon, a totally unique visual effect is created wherein some pieces flutter horizontally, and fall relatively slowly, while others twirl vertically and fall more rapidly, and others dart sideways as they flutter downwardly. This creates a constantly changing pattern of dynamic motions in the air, which dynamic motions further add to the initial burst effect as the individual pieces execute different directions of aerodynamic movements relative to each other.

Figure 9:
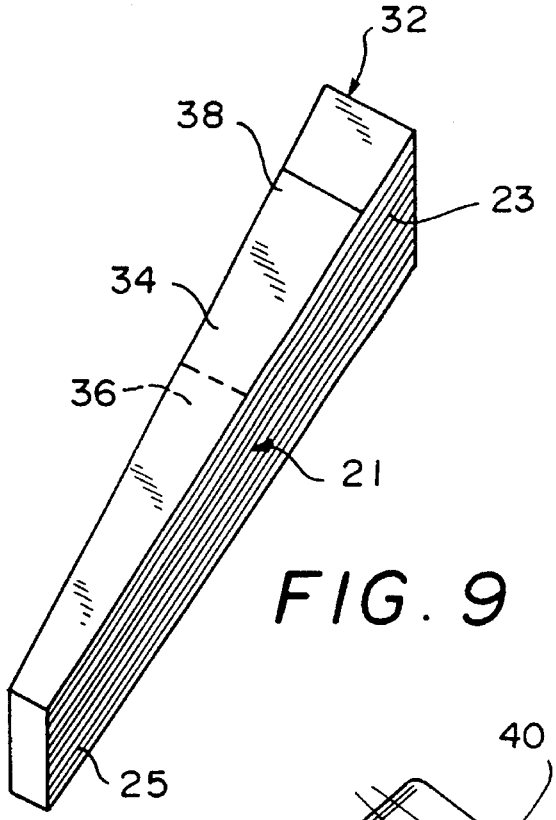
FIG. 9 is a perspective view of a wrapped bundle of multiple pieces of confetti of the shape illustrated in FIG. 5.

Referring now to FIG. 9, a large plurality of pieces of FLUTTER FETTI confetti, such as hundreds or over a thousand, are illustrated as being formed in a bundle 32 with the longitudinal axis of each piece being parallel to that of the other pieces, and all of the pieces lying face to face to form a stack. The individual pieces may be all of the same specific shape, such as the elongated truncated triangular shape illustrated, or they may be a mixture of different shapes such as pieces 10, 12, 14, 16 and 21, or any combination of such shapes.

A wrapper 34 composed of paper, tissue paper or plastic film is wrapped several times about bundle 32 to secure all of the pieces in the stack. This may be accomplished by starting with an end 36 of the wrapper lying against the outer face of the bundle, and then winding the wrapper 1.5 to 5 times about the stack lengthwise so as to extend over and parallel to the outer faces of the stack; ie, parallel to the longitudinal axes of the pieces, and around the ends 23, 25 of the pieces of confetti 21. The opposite end 38 of the wrapper may be taped, glued or otherwise secured, such as by a rubber band, against unwrapping during shipment.

Figure 10:
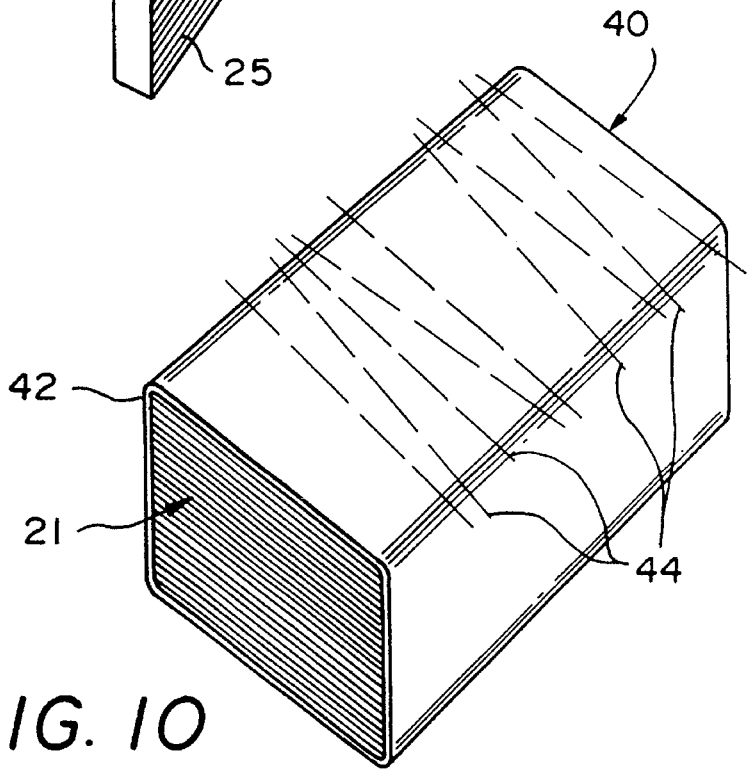
FIG. 10 is a perspective view of an intermediate stack of wrapped sheets of confetti material during the preferred method of manufacturing confetti in wrapped bundles.

While the stack of pre-cut pieces of confetti 21 may be hand-wrapped as just described, it will be understood that a significant amount of care and time are required to individually wrap stacks of pre-cut confetti, particularly in the case of the elongated truncated triangular shape of FIG. 5 having narrow ends 25. Therefore, the preferred wrapping method is to first form an intermediate rectangular stack 40, as shown in FIG. 10, and wrap the entire stack 40 with a wrapper 42 before cutting the intermediate stack along angled cut lines 44 to form individual stacks of elongated truncated triangular confetti 21; this preferred method of wrapping being more fully described in detail in co-pending application Ser. No. 08/108,245 now U.S. Pat. No. 5419731 the complete specification of which is hereby incorporated by reference. All of cut lines 44 may be made at acute angles to lines perpendicular to the length of stack 40, as shown at the right-hand portion of FIG. 10, or alternate lines of cut may be made perpendicular to the length of the stack with alternate lines at acute angles to the perpendicular lines as shown at the left-hand portion of FIG. 10. In the first case, pieces 21 are cut as truncated isosceles triangles, and in the latter case, pieces 21 are cut as truncated triangles having two right-angle corners, one at each end; both forms of truncated triangles having been found to execute the vertical twirling motion previously described.

The wrapped stacks remain secured as bundles during handling and shipment prior to being launched into the air from a compressed gas cannon or thrown into the air by hand. Such wrapped bundles of confetti of different shapes form concentrated masses which may be thrown or otherwise projected 50–70 feet into the air, at which point, the wrappers unwrap, and the stacks of different aerodynamically shaped confetti pieces burst in all directions creating the visual image of real fireworks, followed by the relatively slow, fluttering, darting and twirling descent of hundreds or thousands of the individual pieces of confetti executing different movements as they fall through the air.

From the foregoing description of several preferred embodiments of the invention it will be apparent that different aerodynamic shapes of individual pieces of confetti have been discovered which unexpectedly result in substantially different forms of motion as they descend through the air in unique visual displays of color and movement. However, it is to be understood that the foregoing description of preferred embodiments is intended to be illustrative, rather than limiting of the invention, and that the legal scope of the invention is not to be limited other than as defined by the following claims under the doctrine of equivalents.

What is claimed is:

1. A large plurality of elongated tetragonal pieces of confetti aligned in a stack, said large plurality of pieces being composed of tissue paper and including first and second groups of pieces of two different aerodynamic shapes, said first group of pieces of elongated tetragonal confetti having aerodynamic shapes comprising elongated rectangles having lengths, widths and length to width ratios such that the pieces of said first group fall through the air with their longitudinal axes extending substantially horizontal while rotating about said horizontal axes, and said second group of pieces of elongated tetragonal confetti having aerodynamic shapes comprising elongated truncated triangles having lengths, widths and length to width ratios such that the pieces of said second group fall through the air with their longitudinal axes extending substantially vertically while rotating about said vertical axes.

2. The aligned stack of pieces of elongated tetragonal confetti of claim 1 further including a third group of pieces of confetti, the pieces of confetti of said third group having different aerodynamic shapes comprising shorter truncated triangles and having lengths, widths and length to width ratios such that the pieces of confetti of said third group dart sideways as they fall through the air.

3. An aligned stack of pieces of confetti composed of tissue paper, said pieces of confetti being in the shape of elongated tetragons, said tetragons having faces, lengths and widths, and said lengths being substantially greater than said widths, each of said tetragonal pieces of confetti having first and second ends, the width of said first ends being in the order of ½ to 1 inch and the widths of said second ends being in the order of 1/32 to ¼ inch such that each of said plurality of tetragonal pieces of confetti has the shape of an elongated truncated triangle such that said pieces fall with said lengths twirling vertically in the air, and said pieces of elongated truncated triangular confetti being aligned in face-to-face relationship to form a stack of confetti pieces with said lengths of said confetti pieces being aligned substantially parallel to each other to form an aligned stack of truncated triangular pieces of confetti.

4. The aligned stack of pieces of truncated triangular confetti of claim 3 wherein said lengths are in the order of 3 to 6 inches and the length to width ratios are in the order of 3 to 12.

* * * * *